US006480692B2

(12) United States Patent
Yamazaki et al.

(10) Patent No.: US 6,480,692 B2
(45) Date of Patent: Nov. 12, 2002

(54) TONER SUPPLY ROLLER AND DEVELOPING APPARATUS

(75) Inventors: Hirotaka Yamazaki; Junji Sakata, both of Tokyo (JP)

(73) Assignee: Bridgestone Corporation, Tokyo (JP)

( * ) Notice: Subject to any disclaimer, the term of this patent is extended or adjusted under 35 U.S.C. 154(b) by 0 days.

(21) Appl. No.: 09/803,899

(22) Filed: Mar. 13, 2001

(65) Prior Publication Data

US 2001/0036376 A1 Nov. 1, 2001

(30) Foreign Application Priority Data

| | | |
|---|---|---|
| Mar. 31, 2000 | (JP) | 2000-096527 |
| May 17, 2000 | (JP) | 2000-144558 |
| May 17, 2000 | (JP) | 2000-144559 |
| Jun. 23, 2000 | (JP) | 2000-188812 |

(51) Int. Cl.[7] ..... G03G 15/08
(52) U.S. Cl. ..... 399/281; 399/286; 492/18
(58) Field of Search ..... 399/281, 272, 399/279, 265, 286; 430/120; 492/18

(56) References Cited

U.S. PATENT DOCUMENTS 5,170,213 A * 12/1992 Yamaguchi et al. ..... 399/281
5,324,884 A * 6/1994 Honda et al. ..... 399/279
5,600,417 A * 2/1997 Iguchi et al. ..... 399/279
5,655,197 A * 8/1997 Okada et al. ..... 399/281
6,282,394 B1 * 8/2001 Sakai et al. ..... 399/281

* cited by examiner

*Primary Examiner*—Sophia S. Chen
(74) *Attorney, Agent, or Firm*—Oblon, Spivak, McClelland, Maier & Neustadt, P.C.

(57) ABSTRACT

There are disclosed a toner supply roller which is composed of a foamed elastic body, and has a compression spring constant of 0.25 to 5.0 N/mm, and preferably has the number of cells per a length of 25 mm being 50 to 1200 in the foamed elastic layer; a developing apparatus which is equipped with the above toner supply roller and capable of affording images free from defect such as unevenness in pitch, density, etc.; another developing apparatus which is equipped with a toner supply roller and a developing roller, each being electroconductive, and which satisfies the requirement that the electric resistance of the toner supply roller is always lower than that of the developing roller at an impressed voltage of 100V to 500V, thereby enabling formation of satisfactory images by favorable electrification with the toner supply roller due to favorable adsorption of a toner onto the developing roller; and an image formation apparatus equipped with any of the above developing apparatuses.

21 Claims, 5 Drawing Sheets

TONER SUPPLY ROLLER AND DEVELOPING APPARATUS

BACKGROUND OF THE INVENTION

1. Field of the Invention

The present invention relates to a toner supply roller in a developing apparatus in a printer of electrophotographic system, electrostatic recording system and the like; and the developing apparatus. More particularly, the present invention pertains to a toner supply roller mounted on a developing apparatus which has a toner cartridge housing a toner as a developer, a toner supply roller and a developing roller, and which forms a toner image by supplying an electrostatic latent image on the surface of a photosensitive body with the toner; and the above-mentioned developing apparatus.

2. Description of the Related Arts

In recent years, there has widely been introduced an electroconductive roller system in a developing roller and toner supply roller that are employed in a developing apparatus which is arranged on a developing process in an electrophotographic apparatus such as an electronic copying machine, laser beam printer and facsimile machine. In the aforesaid system, the toner supply roller is rubbed against the developing roller so as to frictionally electrify the toner, and thus is required to possess a stable friction property (pressing force) with the developing roller and also an enhanced toner supply property to frictional portions and positions.

Such being the case, in the conventional toner supply roller of this type, there is generally employed a foamed elastic material wherein rubber or polyurethane is foamed.

However, as a result of investigation made by the present inventors on the performance of the conventional toner supply roller comprising the foamed elastic body, it has been proved that a defect due to unevenness in pitch or density sometimes occurs in a developed image.

In addition, the above-mentioned electroconductive roller system is characterized in that ① the product cost can be lowered because of non-use of an expensive magnet roller, ② a unary non-magnetic developer (toner) can be used, and ③ the space can be curtailed. Such electroconductive developing roller and electroconductive toner supply roller are required to have a low electric resistance.

In the electroconductive roller of this type, there has hitherto been generally used an electroconductive high molecular material such as rubber and polyurethane that are blended with carbon black or an electroconductivity imparting agent.

However, comparing a developing roller which is used always in contact with a drum composed of a photosensitive body with a toner supply roller which is used always in contact with a toner as a developer, the materials which are suitable for the respective objects are selected for use because of different characteristics to be taken into consideration for the other object in contact therewith, and also the materials which have each a low electric resistance are used for the purpose of manifesting electroconductivity. In spite of the above-mentioned consideration, it has been proved that a defect sometimes takes place in a developed image.

SUMMARY OF THE INVENTION

A general object of the invention, which has been made in the light of such circumstances, is to provide an toner supply roller that is composed of a foamed elastic body and is capable of affording an image free from such defect as unevenness in pitch or density, and at the same time, to provide a developing apparatus on which the toner supply roller is mounted.

Another object of the invention is to provide a developing apparatus which always forms an image free from any defect in the development by means of electroconductive roller system.

Still another objects of the invention will be obvious from the content of the specification hereinafter disclosed.

Investigations were made by the present inventors on the toner supply rollers which previously generated the aforestated defective image. The results are as follows:

(1) It has been found out that the hardness of a toner supply roller, when being unreasonably high, results in the occurrence of unevenness in pitch in an image due to variation in the rotational torque of a developing roller, whereas said hardness, when being unreasonably low, causes the occurrence of unevenness in density in an image due to the incapability of sufficiently supplying the developing roller with a toner. In particular, it has also been found that when an image having a high density such as a black solid image is printed immediately after the printing of an image having a low density such as a white solid image, there is generated unevenness in density in which the printed tip end density of the black solid image is higher than the printed rear end density thereof; in the case of white solid printing, because of a small amount of conveyed toner from a developing roller to a photosensitive body, the above-mentioned unevenness in density brings about a large amount of residual toner on the developing roller; thereby insufficiency in scraping of the toner with the toner supply roller is prone to occur, thus gradually increasing the amount of residual toner on the developing roller; and when the black solid printing is carried out subsequent to the white solid printing under such conditions, the aforestated unevenness in density is caused by that the image density in the printing during one to two revolutions of the developing roller is higher than the image density in the printing at the rear end portion.

As a result of further accumulated research, it has been found out that a variance in the hardness of a toner supply roller, if present, brings about partially different pressing force against the developing roller, and thus causes partially strong pressing force and partially weak pressing force between the toner supply roller and the developing roller, failing to assure stable friction property (pressing force); and as a result, the rotational torque of the developing roller varies, causing unevenness in pitch in an image, and/or the toner supply property varies, causing defective image such as unevenness in density in an image. It has further been found out that the toner scraping property with the toner supply roller is closely concerned with both the foamed cell diameter in a foamed elastic body and the hardness on and around the surface thereof as well as both the number of cells therein and the hardness on and around the surface thereof.

It has still further been found out that favorable images free from a defect can be formed by uniformly and properly setting the hardness of the toner supply roller expressed in terms of compression spring constant capable of expressing in high precision and accuracy, the partial hardness of a foamed elastic body, and that more favorable images free from a defect can be formed by properly and suitably setting the foamed cell diameter in a foamed elastic body, the number of cells therein as well as the hardness of the toner supply roller expressed in terms of compression spring constant.

(2) It has been found out that the pressing force of a toner supply roller against a developing roller, when being unreasonably strong, results in the occurrence of unevenness in pitch in an image due to variation in the rotational torque of a developing roller, whereas said pressing force thereof, when being unreasonably weak, leads to the occurrence of unevenness in density in an image due to the incapability of sufficiently supplying the developing roller with a toner.

As a result of further accumulated research, it has been found out that improper cutting amount of a developing roller into a toner supply roller in spite of a proper hardness of the toner supply roller brings about failure to assure proper pressing force, thus causing failure to assure stable frictional force; and as a result, there take place defective images such as unevenness in pitch and unevenness in density due to varied toner supply property.

It has still further been found out that favorable images free from a defect can be formed by properly setting the cutting amount of a developing roller into a toner supply roller and at the same time, by properly setting the pressing force of the toner supply roller against the developing roller.

(3) It has been found out that defective images take place in the case where the electric resistance of a toner supply roller is higher than that of a developing roller. As a result of further accumulated research, there were obtained such findings and information in that materials matching respective functions of these two electroconductive rollers can be selected, and favorable images free from a defect can be formed in the case where the materials for these rollers are selected so that the electric resistance of a toner supply roller is always lower than that of a developing roller even if the electric resistance of each roller varies accompanying the change in environment such as temperature and humidity.

The present invention has been accomplished on the basis of the foregoing findings and information.

That is to say, the present invention provides a toner supply roller that is composed of a foamed elastic body and is mounted on a developing apparatus which has a toner cartridge housing a toner as a developer, a toner supply roller and a developing roller, and which forms a toner image by supplying an electrostatic latent image on the surface of a photosensitive body with the toner, characterized in that said toner supply roller has a compression spring constant in the range of 0.25 to 5.0 N/mm; a developing apparatus on which the above-mentioned toner supply roller is mounted; and an image formation apparatus equipped with the aforesaid developing apparatus.

In addition, the present invention provides a developing apparatus which has a toner cartridge housing a toner as a developer, a toner supply roller and a developing roller, and which forms a toner image by supplying an electrostatic latent image on the surface of a photosensitive body with the toner, characterized in that the toner supply roller and the developing roller are each electroconductive, and the electric resistance of the toner supply roller is always lower than the electric resistance of the developing roller at an impressed voltage in the range of 100V to 500V; and an image formation apparatus equipped with the developing apparatus just described.

DETAILED DESCRIPTION OF THE INVENTION

Figure 1:
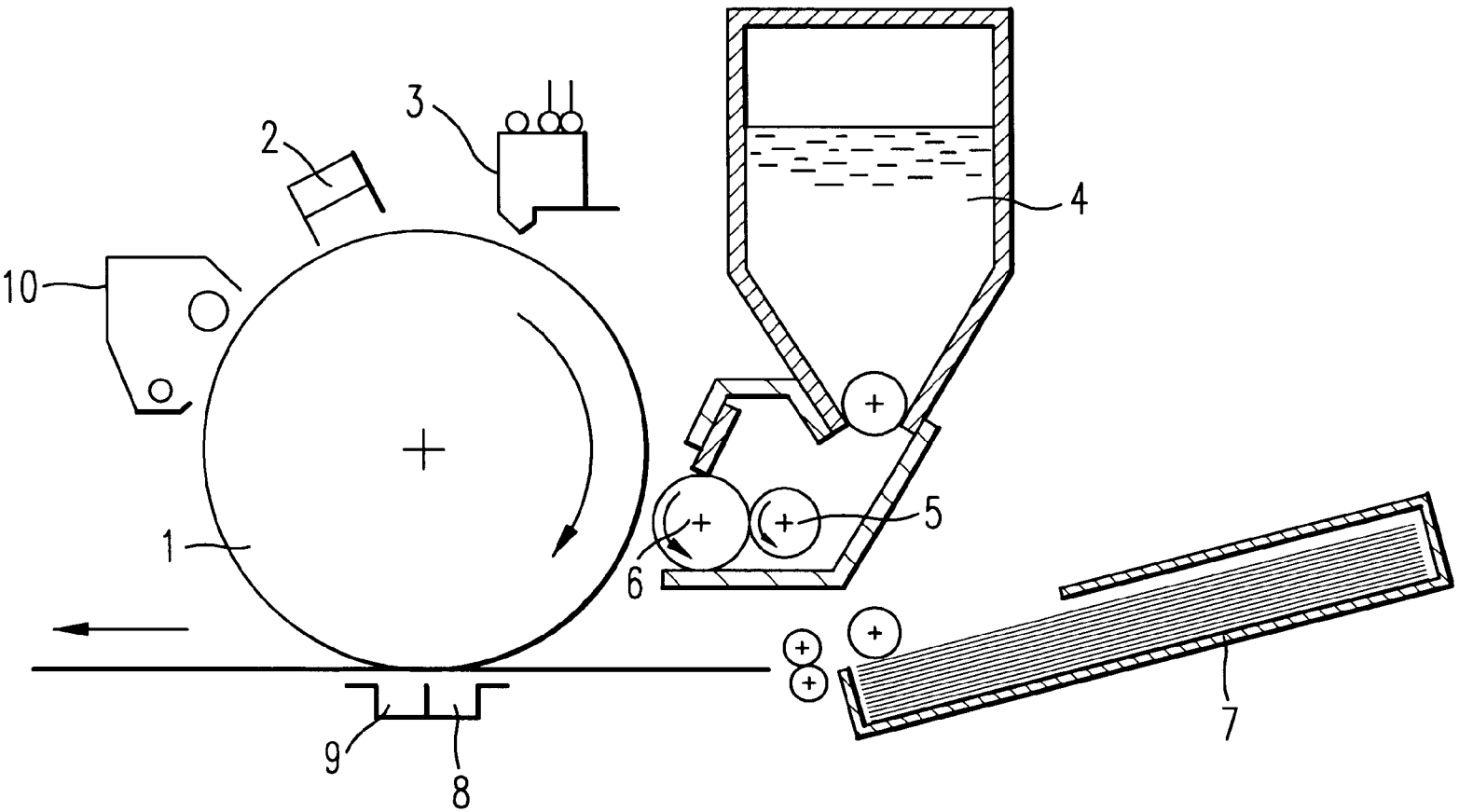
FIG. 1 is a schematic illustration showing the developing portion of a laser printer as an example of the developing apparatus according to the present invention.

The toner supply roller according to the present invention has a compression spring constant in the range of 0.25 to 5.0 N/mm, preferably 0.4 to 4.0 N/mm, particularly preferably 0.7 to 3.0 N/mm. The compression spring constant thereof, when being less than 0.25 N/mm, leads to such disadvantage as insufficient frictional electrification of a toner, whereas said constant, when being more than 5.0 N/mm, results in such disadvantage as insufficient conveying of a toner.

It is preferable in the toner supply roller according to the present invention that the variation range of compression spring constant thereof in the circumferential direction of the roller be within the range of a prescribed value (the value of compression spring constant which is set in the range of 0.25 to 5.0 N/mm) ±20%. The variation range thereof, when being outside the prescribed value ±20% , gives rise to a fear of failure to assure favorable image. In addition, it is preferable in the toner supply roller according thereto that the variation range of compression spring constant thereof in the longitudinal direction of the roller in the region excluding the range of from both the ends to the places 20 mm distant from the ends be within the range of a prescribed value ±20% . The variation range thereof, when being outside the prescribed value ±20% gives rise to a fear of failure to assure favorable image.

It is preferable in the toner supply roller according to the present invention that the average foamed cell diameter of a foamed elastic body which constitutes the toner supply roller be in the range of 20 to 200 $\mu$m and that the number of cells per a length of 25 mm be in the range of 50 to 1200 in addition to that the compression spring constant thereof is in the range of 0.25 to 5.0 N/mm. The average foamed cell diameter thereof is more preferably in the range of 50 to 180 $\mu$m . The average foamed cell diameter thereof of at least 20 $\mu$m exerts the working effect of being less prone to cause clogging due to a toner, and preventing the hardness on and around the surface of the roller from becoming unreasonably high, whereas the diameter of at most 200 $\mu$m exerts the working effect of preventing the amount of the toner penetrating inside the roller from unreason ably increasing, and being capable of preferable toner supply.

The above-mentioned number of cells per a length of 25 mm is more preferably in the range of 100 to 450. The number of cells per said length of at least 50 exerts the working effect of being capable of uniform toner supply to the developing roller, whereas the number of cells per said length of at most 1200 exerts the working effect of being capable of sufficiently scraping away the residual toner on the developing roller.

The foamed elastic body which constitutes the toner supply roller needs only to be equipped with the aforestated properties and is exemplified by ester-based polyurethane foam, ether-based polyurethane foam and foam of a rubber material such as nitrile rubber, ethylene-propylene rubber, ethylene-propylene-diene rubber, styrene-butadiene rubber, butadiene rubber, isoprene rubber, natural rubber, silicone rubber, acrylic rubber, chloroprene rubber, butyl rubber and epichlorohydrin rubber. Any of the above-exemplified foam may be used alone or in combination with at least one other. Of these are particularly preferable ester-based polyurethane foam, ether-based polyurethane foam, nitrile rubber foam, ethylene-propylene rubber foam, ethylene-propylene-diene rubber foam and silicone rubber foam.

The toner supply roller according to the present invention may be electroconductive, and can be manufactured by forming an electroconductive foamed elastic layer outside a favorably electroconductive shaft such as a metallic shaft as is the case with the product which has hitherto been usually used as an electroconductive toner supply roller. There are usable as a material for the metallic shaft, galvanized steel such as galvanized sulfur free cutting steel, aluminum, stainless steel, phosphor bronze and the like material.

In the above-mentioned electroconductive foamed elastic layer, use is made of a foamed elastic material that is produced by imparting electroconductivity to a suitable foamed elastic body. Likewise, in the case of the electroconductive foamed elastic body, the number of cells per a length of 25 mm is in the range of preferably 50 to 1200, particularly preferably 100 to 450.

Moreover, an ionic electroconductivity imparting agent and/or an electronic electroconductivity imparting agent is used as an electroconductivity imparting agent to be incorporated in the case of imparting electroconductivity to the foamed elastic body. Examples of the ionic electroconductivity imparting agent include ammonium salts such as perchlorates, chlorates, hydrochlorides, bromates, iodates, borofluorides, sulfates, ethyl sulfates, carboxylates, sulfonates, etc. of any of tetraethyl ammonium, tetrabutyl ammonium, dodecyltrimethyl ammonium such as lauryltrimethyl ammonium, hexadecyltrimethyl ammonium, octadecyltrimethyl ammonium such as stearyltrimethyl ammonium, benzyltrimethyl ammonium, modified aliphatic dimethylethyl ammonium, etc.; perchlorates, chlorates, hydrochlorides, bromates, iodates, borofluodides, trifluoromethyl sulfates, sulfonates, etc. of any of alkali metals such as lithium, sodium and potassium, or alkaline earth metals such as calcium and magnesium.

Examples of the electronic electroconductivity imparting agent include electroconductive carbon black such as ketchen black and acetylene black, carbon black for rubber such as SAF, ISAE, HAF, FEF, GPF, SRF, FT and MT; oxidation treated carbon black for ink; thermally cracked carbon black; natural graphite; artificial graphite; electroconductive metal oxides such as tin oxide, titanium oxide and zinc oxide; and metals such as nickel, copper, silver and germanium.

The above-exemplified electroconductivity imparting agent may be used alone or in combination with at least one other. The amount thereof to be added is not particularly limited. It is selected in the range of usually 0.01 to 5 parts by weight, preferably 0.05 to 2 parts by weight based on 100 parts by weight of the foregoing foamed elastic body in the case of the above-mentioned ionic electroconductivity imparting agent, and in the range of usually 1 to 50 parts by weight, preferably 5 to 40 parts by weight based on 100 parts by weight of the foregoing foamed elastic body in the case of the aforesaid electronic electroconductivity imparting agent. The electroconductive elastic layer may be properly and optionally incorporated at need, with an other additive for rubber such as well known filler and cross-linking agent in addition to the foregoing electroconductivity imparting agent.

Moreover in the case where polyurethane foam is used for forming the electroconductive foamed elastic body of the toner supply roller, it is preferable to limit the acetone extraction rate for the polyurethane foam to at most 5% by weight so as to prevent a toner from being fusedly adhered to a deposit on the surface of the roller. Accordingly, it is necessary to closely examine the blending amount of the electroconductivity imparting agent to be added thereto. That is to say, blending of a large amount of carbon black rich in volatile matters (for instance, channel black) increases the acetone extraction rate therefor, whereas blending of carbon black having a large oil absorption (for instance, acetylene black and oil furnace black with high structure) can decrease the acetone extraction rate therefor.

The toner supply roller according to the present invention can be used by being mounted, for instance, on a developing portion of a laser printer which is one example of developing apparatus and illustrated on FIG. 1.

The surface of a photosensitive body as shown by symbol 1 in FIG. 1 is uniformly charged with a primary electrifier 2. Thereafter an image signal transmitted from a control unit (not shown on the figure) is converted into an optical signal by the use of an LED array print head 3. The optical signal is exposed onto the surface of the photosensitive body 1 so as to form an electrostatic latent image, which is accommodated in a toner cartridge 4, and is developed with a toner that is supplied to the photosensitive body 1 via a toner supply roller 5 and a developing roller 6, so that a toner image is formed.

The toner image which has been formed on the surface of the photosensitive body 1 is transferred to the surface of paper supplied from a paper magazine 7 with a transfer electrifier 8 and fixed with a heat fixing apparatus 9. The paper is conveyed and discharged in the direction of the arrow. The photosensitive body 1 after the transfer is returned to the initial state with a cleaning unit 10.

Figure 2A:
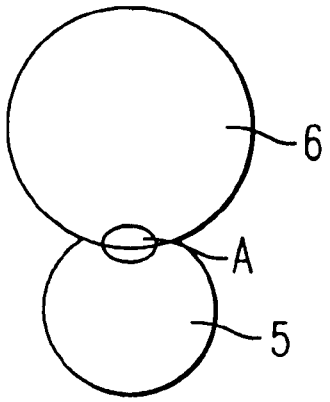
FIG. 2 is a scheme showing a mode of scraping a toner with a toner supply roller according to the present invention.
Figure 2B:
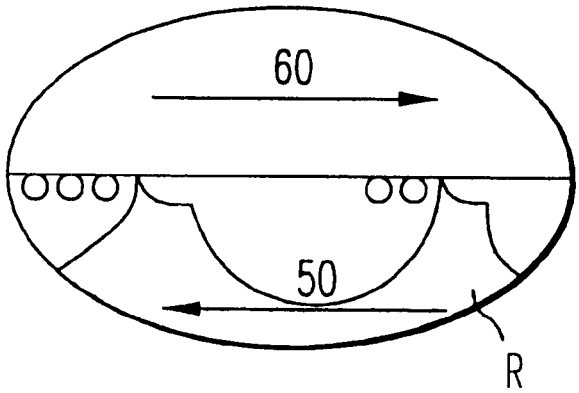

The toner scraping is preferably carried out by the use of the toner supply roller 5 in which the compression spring constant is in the range of 0.25 to 5.0 N/mm, the average foamed cell diameter of a foamed elastic body which constitutes the toner supply roller is in the range of 20 to 200 $\mu$m , and the number of cells per a length of 25 mm is in the range of 50 to 1200. FIG. 2 is a scheme showing a mode of scraping a toner with a toner supply roller 5, in which FIG. 2(B) is an enlarged view for the portion as indicated by the symbol A in FIG. 2(A). In regard to FIG. 2(B), the peak portions in the region R are cell walls, and the distance between the peaks corresponds approximately to the foamed cell diameter. Since the butt contact portion 60 of the toner supply roller 5 in the developing roller 6 and the butt contact portion 50 of the developing roller 6 in the toner supply roller 5 move in the direction of arrows, respectively, the cell walls of the toner supply roller 5 are pushed down by the force of friction between the butt contact portion 60 and the cell walls in the direction opposite to the direction of progress of the butt contact portion 50. However, the cell walls, when pushed down to some extent, tends to be restored by the spring force thereof. At the time of this restoration, a slip is caused, so that the cell walls move instantaneously, thereby enabling the toner supply roller 5 to scrape the toner {as shown by black solid circles on FIG. 2(B)} on the developing roller 6.

Since the foamed cell diameter and the number of cells per unit length in the foamed elastic body are independent of each other, the spring force of the cell walls is optimized by optimizing the aforesaid foamed cell diameter and the number of cells, whereby the scraping property of the residual toner is optimized. The compression spring constant which represents the partial hardness on and around the surface of the roller proves to be a parameter which indirectly points out the restoration force (spring force) of the cell walls. Accordingly, the use of a roller which is appropriate in foamed cell diameter, number of cells per unit length and compression spring constant as a toner supply roller makes it possible to markedly improve the toner scraping property and at the same time to carry out development free from any defect.

Preferably, the compression spring constant of the toner supply roller is lower than that of the developing roller in the developing apparatus according to the present invention. The compression spring constant of the toner supply roller, when being higher than that of the developing roller, brings about a fear that the developing roller is deformed when being brought into butt contact with the toner supply roller, thus failing to supply a constant amount of a toner. Preferably, the difference between the compression spring constant of the toner supply roller and that of the developing roller is set to at least 30N/mm.

It is desirable to arrange the toner supply roller so that when the developing roller is in butt contact with the toner supply roller, the deformation of the former is substantially due to the deformation of the latter, the cutting amount in the latter by the former is 0.5 to 2 mm, preferably 0.5 to 1.5 mm, and pressing force against the former is at most 6.0N, preferably at most 5.0N.

The cutting amount in the toner supply roller by the developing roller, when being less than 0.5 mm, causes a fear that the toner left on the developing roller can not sufficiently be scraped, whereas said amount, when being more than 2 mm, brings about a fear that the toner can not sufficiently be conveyed to the developing roller. The pressing force of the toner supply roller against the developing roller, when exceeding 6.0N, gives rise to a fear of variations in rotational torque of the developing roller.

The developing roller which is employed in the aforesaid developing apparatus according to the present invention is electroconductive, and can be manufactured by forming an electroconductive elastic layer outside a favorably electroconductive shaft as is the case with the product which has hitherto been usually used as an electroconductive developing roller. In the above-mentioned electroconductive elastic layer, use is made of an elastic material that is produced by imparting electroconductivity to a suitable rubbery elastic body. The rubbery elastic body is not specifically limited, but may be selected for use from those that have hitherto been customarily used as an electroconductive developing roller.

Preferable examples of the rubbery elastic body include nitrile rubber, ethylene propylene rubber, ethylene propylene diene rubber, styrene butadiene rubber, butadiene rubber, isoprene rubber, natural rubber, silicone rubber, urethane rubber, acrylic rubber, chloroprene rubber, butyl rubber and epichlorohydrin rubber. The above-exemplified rubbery elastic body may be used alone or in combination with at least one other. Of these are preferable nitrile rubber, urethane rubber, epichlorohydrin rubber, ethylene propylene rubber, ethylene propylene diene rubber and silicone rubber.

It is preferable in the developing roller according to the present invention to place a resin coating layer 80 in a thickness of 1 to 100 $\mu$m on the surface thereof to prevent fouling of the photosensitive body, said resin being composed of for instance, alkyd resin, phenolic resin, melamine resin, a cross-linkable resin such as a mixture thereof, etc. The cross-linkable resin may be incorporated at need, with any of various additives such as an antistatic agent, a lubricant, an electroconductivity imparting agent, an other resin, etc. The resin coating layer can be formed usually by coating the elastic layer with a coating liquid in which a cross-linkable resin, a cross-linking agent and any of various additives are dissolved or dispersed in a liquid or a solvent exemplified by an alcohol-based solvent such as methanol and a ketone-based solvent such as methyl ethyl ketone by means of dipping method, roll coater method, doctor blade method, spraying method or the like; and thereafter drying the coating liquid at ordinary temperature or at 50 to 170° C. to cross-linkably cure the dried coating.

The toner supply roller according to the present invention is capable of affording an image free from any defect such as unevenness in pitch or density. Likewise, the developing apparatus equipped with the aforesaid toner supply roller is capable of affording a satisfactory image free from any defect such as unevenness in pitch or density, by virtue of favorable and appropriate implementation relating to the pressing action of the toner supply roller against the developing roller, to the toner supply and scraping with the toner supply roller and to the conveyance of the toner to the developing portion of the photosensitive body without causing variation in rotational torque of the developing roller.

Another developing apparatus according to the present invention is characterized by such requirements that the developing roller is electroconductive, and that the electric resistance of the toner supply roller is always lower than the electric resistance of the developing roller at an impressed voltage in the range of 100V to 500V. As one example of the developing apparatus constitution, there is cited the developing apparatus having the constitution same as that shown in FIG. 1. As the developing roller, use is made of the developing roller same as that used in the above-mentioned developing apparatus. As the toner supply roller, there is usable the toner supply roller which is manufactured in the same manner as the foregoing. As is the case with the above-mentioned toner supply roller, it is preferable to use a toner supply roller having a compression spring constant in the range of 0.25 to 5.0 N/mm.

The foamed elastic body which constitutes the toner supply roller has an Asker F hardness in the range of preferably 30 to 100 degrees, more preferably 40 to 100 degrees, most preferably 50 to 100 degrees. In addition, the number of cells per a length of 25 mm of the aforesaid foamed elastic body is preferably in the range of 50 to 1200.

The electroconductive roller has an electric resistance value usually in the range of $10^4$ to $10^{11}$ Ω. Within such range of electric resistance, the objects of the present invention are achieved when the the electric resistance of the toner supply roller is always lower than the electric resistance of the developing roller. It is particularly preferable that difference therebetween expressed in terms of common logarithm value of electric resistance value (Ω) be at least 0.5

The developing apparatus according to the present invention include the embodiment such as jumping development in which the developing roller and the photosensitive body are placed in non-contact condition, but particularly enhanced effect is obtained in the case of contact electroconductive roller wherein the developing roller is in contact with the photosensitive body.

Speaking of the relation between the electric resistance of an electroconductive developing roller and electric resistance of an electroconductive toner supply roller, as for the developing apparatus in which the electric resistance of the electroconductive toner supply roller is always lower than that of the electroconductive developing roller at a practical impressed voltage of 100V to 500V, satisfactory images can be always formed, since the electrification of a toner with the toner supply roller is preferably performed and thus, the electrified toner is preferably adsorbed onto the developing roller.

In the following, the present invention will be described in more detail with reference to comparative examples and working examples, which however shall never limit the present invention thereto.

EXAMPLES 1 to 3 and Comparative Examples 1 to 5

The printer as illustrated in FIG. 1 was incorporated with a developing roller A and a toner supply roller B, C, D, E, F, G, H or I, and images were formed under environmental conditions of low temperature and low humidity (15° C., 10% RH) to evaluate the images thus formed.

The developing roller A used there was manufactured by the following method:

By the use of a mixer, a polyol composition was prepared by mixing 100 parts (parts by weight, the same applies hereinafter unless otherwise noted) of polyether polyol having a molecular weight of 5000 and an OH value of 33 mgKOH/g which had been prepared by adding propylene oxide and ethylene oxide to glycerol; 1.0 part of 1,4-butanediol; 0.5 part of nickel acetylacetonato; 0.01 part of dibutyltin dilaurate and 0.005 part of sodium perchlorate. The polyol composition thus prepared was defoamed by stirring under reduced pressure, then incorporated with 17.5 parts of urethane-modified MDI (diphenylmethane diisocyanate), and stirred for 2 minutes.

Subsequently, the resultant mixture was cast into a mold in which a metallic shaft had been heated in advance to 110° C., was cured at 110° C. for 2 hours to form an electroconductive elastic layer on the outer periphery of the metallic shaft and thus to obtain a roller. The surface of the roller thus obtained was polished and adjusted to an average roughness Rz of 4.0 $\mu$m according to JIS 10 points.

Subsequently, a resin for forming a resin coated layer was prepared by mixing an oil-free alkyd resin (manufactured by Dainippon Ink and Chemicals, Inc. under the trade name "M 6402") and a melamine resin (solid content rate of 60% by weight, manufactured by Dainippon Ink and Chemicals, Inc. under the trade name "Superbekkamin L-145-60") so as to attain a solid content ratio by weight of the oil-free alkyd resin to the melamine resin of 80/20 in methyl ethyl ketone as the solvent, wherein the solid concentration was adjusted to 20% by weight.

Subsequently, 100 parts by weight expressed in terms of solid content of the resultant mixture was mixed with 20 parts (20 phr) by weight of carbon (average particle diameter of 18 nm, manufactured by Degussa Corp. under the trade name"PrintexL6"), and the resultant mixture was dispersed by the use of a paint shaker to prepare a coating solution.

The above-prepared roller was immersed into the coating solution, drawn up, and heated at 130° C. for 3 hours to cure the same and thus produce a developing roller A equipped with the resin coated layer.

In addition, toner supply rollers B, C, D, E, F, G, H, and I which were used here were produced by using polyol prepolymers as the principal starting materials that had been prepared in the following manner.

A mixture was prepared by mixing 20 g of the mixture of 2,4-tolylene diisocyanate and 2,6-tolylene diisocyanate at a ratio by weight of 8:2 with a total weight of 90 g of the blend composed of polymer polyol (hereinafter called "polyol X") having about 28% by weight of solid content composed, as a base polyol, of polyether polyol which had a weight average molecular weight of 5000 and which had been prepared by the addition to glycerol, of 15% by weight of ethylene oxide and 85% by weight of propylene oxide; hydrophilic polyether polyol (hereinafter called "polyol Y") which had a weight average molecular weight of 3400 and which had been prepared by the addition to glycerol, of 75% by weight of ethylene oxide and 25% by weight of propylene oxide; and polyether polyol (hereinafter called "polyol Z") which had a weight average molecular weight of 4800 and which had been prepared by the addition to glycerol, of 15% by weight of ethylene oxide and 85% by weight of propylene oxide. The resultant mixture was sufficiently stirred, heated to 60° C., and stirred every 12 hours repeatedly. Thus after 48 hours there was obtained a prepolymer of polyether polyol.

Subsequently, 110 g of the resultant prepolymer was mixed with 20 g of water, 0.1 g of tetraethylenediamine as an amine catalyst, 2.5 g of silicone-based antifoam in which a hydroxy group was introduced at a terminal and 2.5 g of acetylene black.

Then the resultant mixture was poured into a cylindrical mold the inside of which was coated with teflon and an end of which was closable with a detachable lid, in an amount 0.9 to 1.5 times a prescribed amount (a value which corresponds to the internal volume of a mold, and which is set to a standard prescribed amount of 1.0), and the lid was closed. Then the mold containing the mixture was allowed to stand in a hot air oven regulated to 70° C. for 8 to 10 hours to obtain foamed and cured polyurethane foam products each having a different hardness. Table 1 indicates the blending amounts of the polyol components for preparing the toner supply rollers B, C, D, E, F, G, H and I along with the amounts of blends poured into the mold.

TABLE 1

| | Parts by weight of polyol | | | Factor of poured amount |
|---|---|---|---|---|
| | Polyol X | Polyol Y | Polyol Z | (x prescribed value) |
| Roller B | 20 | 40 | 40 | 1.0 |
| Roller C | 20 | 40 | 40 | 1.1 |
| Roller D | 40 | 40 | 20 | 1.5 |
| Roller E | 10 | 40 | 50 | 0.9 |
| Roller F | 50 | 40 | 10 | 1.5 |
| Roller G | 30 | 40 | 30 | 1.0 |
| Roller H | 30 | 40 | 30 | 1.1 |
| Roller I | 35 | 40 | 25 | 1.5 |

Subsequently, the cured polyurethane foam was removed from the mold, passed through a roll, and subjected to glassing treatment.

Then, a hole with an inside diameter of 5 mm was bored at the center of the circular end of the cylindrical column, and into the hole was pressed a shaft which was made of galvanized sulfur free cutting steel, coated thereon with an adhesive and had an outside diameter of 6.0 mm and a length o 240 mm. The shafted polyurethane foam was subjected to heating adhesion treatment for 15 minutes in an oven at 60° C., and thereafter was polished with a grindstone, so that the outside diameter of the cylindrical column was made to be 13.0 mm, whereby eight kinds of toner supply rollers B, C, D, E, F, G, H, and I each having a different hardness (compression spring constant) was produced. The number of cells per a length of 25 mm in each of the toner supply rollers B, C, D, E, F, G, H, and I was in the range of 170 to 200.

Figure 3:
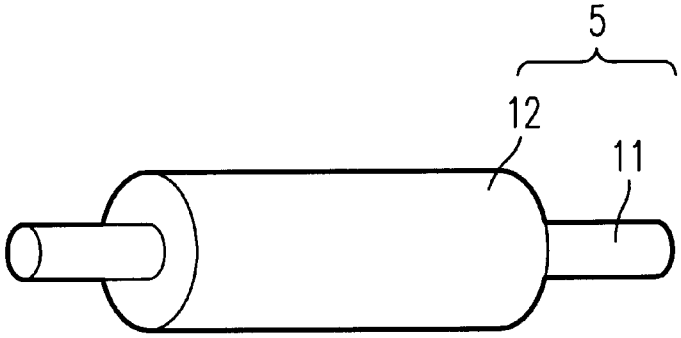
FIG. 3 is a schematic perspective illustration showing the toner supply roller according to the present invention.

As illustrated in FIG. 3, the toner supply roller according to the present invention is constituted into a foamed elastic roller in which a roller 12 of a foamed elastic body is arranged around a metallic rotational shaft 11. In regard to the examples and comparative examples, image formation tests were carried out, by arranging the aforesaid toner supply roller as a toner supply roller 5 of the printer as illustrated in FIG. 1.

Figure 4:
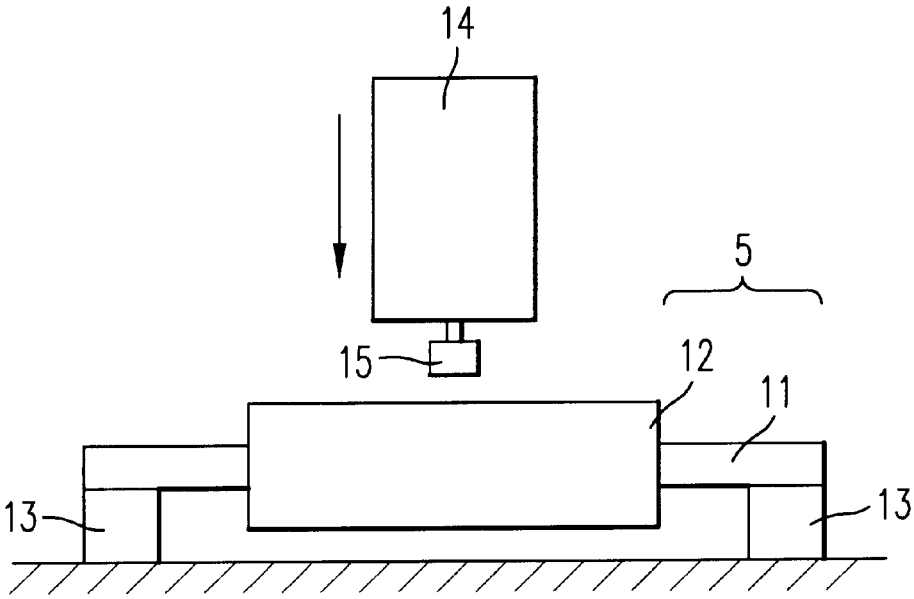
FIG. 4 is a schematic illustration showing a method for measuring the compression spring constant of the toner supply roller as indicated in working examples.

Moreover, by the measuring method as illustrated in FIG. 4, a measurement was made of the compression spring constant for the roller of foamed elastic body in both the peripheral and longitudinal directions thereof. As illustrated in FIG. 4, a rotational shaft 11 of a toner supply roller 5 was horizontally fixed to V blocks 13; a force gauge 14 arranged above a foamed elastic roller 12 was moved downwards at a constant velocity (0.1 mm/sec); a disc shaped compression jig (disc shaped penetrator) 15 with a diameter of 13 mm which was installed at the lower end of the force gauge 14 was pressed into the elastic roller 12 at a depth of about 1.0 mm to obtain stress-strain diagram; and the compression spring constant was calculated therefrom. The measurement was made at an interval of 30 mm in the longitudinal direction of the roller and at an interval of 30 degrees in the peripheral direction thereof, and variation range was calculated based on the median (prescribed value).

According to the measuring method as illustrated in FIG. 4, it has been made possible to measure a partial or local surface hardness of a roller which has heretofore been unable to measure with the conventionally used F type hardness tester.

The toner supply roller to be used in the present examples and comparative examples was subjected to the test for compression spring constant as illustrated in FIG. 4, and thereafter to image formation tests by arranging the same as a toner supply roller 5 of a printer as illustrated in FIG. 1, wherein the developing roller A was placed as the developing roller 6. Further, the image formation tests in the present examples and comparative examples were carried out under the environmental conditions of low temperature and low humidity (15° C., 10% RH) that were prone to manifest defective images. The results are given in Table 2.

TABLE 2

| | Toner supply roller | Compression spring constant (N/mm) | Variation range in peripheral direction, % | Variation range in longitudinal direction, % | Image evalution |
|---|---|---|---|---|---|
| Example 1 | B | 0.3 | ±10 | ±10 | ○ |
| Example 2 | C | 1.5 | ±15 | ±15 | ○ |
| Example 3 | D | 4.5 | ±18 | ±18 | ○ |
| Comparative Example 1 | E | 0.2 | ±12 | ±12 | x |
| Comparative Example 2 | F | 5.4 | ±15 | ±15 | x |
| Comparative Example 3 | G | 0.4 | ±25 | ±25 | x |
| Comparative Example 4 | H | 1.5 | ±31 | ±31 | x |
| Comparative Example 5 | I | 4.2 | ±28 | ±28 | x |

(Remarks) Regarding image evaluation, deep gray sound images were formed, wherein uniform and good image quality was marked with ○, and non-uniform image quality with unevenness in depth was marked with x.

EXAMPLES 4 to 6 and Comparative Examples 6 to 10

The printer as illustrated in FIG. 1 was incorporated with a developing roller A and a toner supply roller J, K, L, M, N, O, P or Q, and images were formed under environmental conditions of low temperature and low humidity (15° C., 10% RH) to evaluate the images thus formed.

The developing roller A used there was manufactured by the following method:

By the use of a mixer, a polyol composition was prepared by mixing 100 parts (parts by weight, the same applies hereinafter unless otherwise noted) of polyether polyol having a molecular weight of 5000 and an OH value of 33 mgKOH/g which had been prepared by adding propylene oxide and ethylene oxide to glycerol; 1.0 part of 1,4-butanediol; 0.5 part of nickel acetylacetonato; 0.01 part of dibutyltin dilaurate and 0.005 part of sodium perchlorate. The polyol composition thus prepared was defoamed by stirring under reduced pressure, then incorporated with 17.5 parts of urethane modified MDI (diphenylmethane diisocyanate), and stirred for 2 minutes.

Subsequently, the resultant mixture was cast into a mold in which a metallic shaft had been heated in advance to 110° C., was cured at 110° C. for 2 hours to form an electroconductive elastic layer on the outer periphery of the metallic shaft and thus to obtain a roller. The surface of the roller thus obtained was polished and adjusted to an average roughness Rz of 4.0 $\mu$m according to JIS 10 points.

Subsequently, a resin for forming a resin coated layer was prepared by mixing an oil-free alkyd resin (manufactured by Dainippon Ink and Chemicals, Inc. under the trade name "M 6402") and a melamine resin (solid content rate of 60% by weight, manufactured by Dainippon Ink and Chemicals, Inc. under the trade name "Superbekkamin L-145-60") so as to attain a solid content ratio by weight of the oil-free alkyd resin to the melamine resin of 80/20 in methyl ethyl ketone as the solvent, wherein the solid concentration was adjusted to 20% by weight.

Subsequently, 100 parts by weight expressed in terms of solid content of the resultant mixture was mixed with 20 parts (20 phr) by weight of carbon (average particle diameter of 18 nm, manufactured by Degussa Corp. under the trade name"PrintexL6"), and the resultant mixture was dispersed by the use of a paint shaker to prepare a coating solution.

The above-prepared roller was immersed into the coating solution, drawn up, and heated at 130° C. for 3 hours to cure the same and thus produce a developing roller A equipped with the resin coated layer.

In addition, toner supply rollers J, K, L, M, N, O, P and Q which were used here were produced by using polyol prepolymers as the principal starting materials that had been prepared in the following manner.

A mixture was prepared by mixing 21 parts of the mixture of 2,4-tolylene diisocyanate and 2,6-tolylene diisocyanate at a ratio by weight of 8:2 with the blend composed of 20 parts of polymer polyol having about 28% by weight of solid content composed, as a base polyol, of polyether polyol which had a weight average molecular weight of 5000 and which had been prepared by the addition to glycerol, of 15% by weight of ethylene oxide and 85% by weight of propylene oxide; 40 parts of hydrophilic polyether polyol which had a weight average molecular weight of 3400 and which had been prepared by the addition to glycerol, of 75% by weight of ethylene oxide and 25% by weight of propylene oxide; and 40 parts of polyether polyol which had a weight average molecular weight of 4800 and which had been prepared by the addition to glycerol, of 15% by weight of ethylene oxide and 85% by weight of propylene oxide. The resultant mixture was sufficiently stirred, heated to 60° C., and stirred every 12 hours repeatedly. Thus after 48 hours there was obtained a prepolymer of polyether polyol.

Subsequently, 100 parts of the above-prepared prepolymer was mixed with the mixture in a total amount of 29.6 parts consisting of 27 parts of aqueous dispersion of carbon containing electroconductive carbon (carbon content of 8% by weight, manufactured by Lion Corporation under the trade name "Lion Paste W311N") ; 0.1 part of 70% by weight solution of bis(dimethylaminoethyl) ether as a catalyst in dipropylene glycol as the solvent (manufactured by Kao Corporation under the trade name "Kaolizer No.12"); and 2.5 parts of reactive silicone based antifoam in which 70% by weight of ether chain consisted of polyoxyethylene.

Then the resultant mixture was poured into a cylindrical mold the inside of which was coated with teflon and an end of which was closable with a detachable lid in an amounts different from one another, and the lid was closed. The mold containing the mixture was allowed to stand in a hot air oven regulated to 70° C. for 8 to 10 hours to obtain foamed and cured polyurethane foam products each having a hardness, an average foamed cell diameter and the number of cells that were different from one another.

Subsequently, the cured polyurethane foam was removed from the mold by detaching the lid at an end of the cylindrical column, passed through a roll, and subjected to glassing treatment.

Then, a hole with an inside diameter of 5 mm was bored at the center of the circular end of the cylindrical column, and into the hole was pressed a shaft which was made of galvanized sulfur free cutting steel, coated thereon with an adhesive and had an outside diameter of 6.0 mm and a length o 240 mm. The shafted polyurethane foam was subjected to heating adhesion treatment for 15 minutes in an oven at 60° C., and thereafter was polished with a grindstone, so that the outside diameter of the cylindrical column was made to be 13.0 mm. Thus there were produced eight kinds of toner supply rollers J, K, L, M, N, O, P and Q which had the constitution as illustrated in FIG. 3 and had each a hardness (compression spring constant), average foamed cell diameter and the number of cells that were different from one another. The average foamed cell diameter and the number of cells for the foam were obtained by photographing the cells at a magnification of 40 to 60 using a CCD video camera manufactured by Hilox Corp. and measuring the foamed cell diameter and the number of cells for the images, in which the number of cells was measured according to JIS K6402.

In regard to the examples and comparative examples, image formation tests were carried out by arranging the aforesaid toner supply roller as a toner supply roller 5 as illustrated in FIG. 1, and also a measurement was made of the compression spring constant for the roller of foamed elastic body by the measuring method as illustrated in FIG. 4.

The toner supply roller to be used in the present examples and comparative examples, after being tested for compression spring constant as illustrated in FIG. 4, was subjected to image formation tests by arranging the same as a toner supply roller 5 of a printer as illustrated in FIG. 1, wherein the developing roller A was placed as the developing roller 6. Further, the image formation tests in the present examples and comparative examples were carried out under the environmental conditions of low temperature and low humidity (15° C., 10% RH) that were prone to manifest defective images. The results are given in Table 3.

TABLE 3

| | Toner supply roller | Compression spring constant (N/mm) | Cell diameter (μm) | Number of cells (Nos/25 mm) | Image evaluation |
|---|---|---|---|---|---|
| Example 4 | J | 0.7 | 52 | 350 | ○ |
| Example 5 | K | 1.5 | 105 | 325 | ○ |
| Example 6 | L | 3.0 | 175 | 125 | ○ |
| Comparative Example 6 | M | 0.3 | 40 | 625 | x |
| Comparative Example 7 | N | 5.4 | 140 | 175 | x |
| Comparative Example 8 | O | 0.4 | 54 | 450 | x |
| Comparative Example 9 | P | 1.0 | 252 | 80 | x |
| Comparative Example 10 | Q | 3.2 | 184 | 48 | x |

{Remarks} The compression spring constant is the average value of the values measured for all rollers.

Regarding image evaluation, deep gray sound images were formed, wherein uniform and good image quality was marked with ○, and non-uniform image quality with unevenness in depth was marked with x.

EXAMPLES 7 to 10 and Comparative Examples 11 to 13

The printer as illustrated in FIG. 1 was incorporated with a developing roller A and a toner supply roller R, S, T, U or V which had each a roller diameter different from one another, or with a toner supply roller W, or X which had each a compression spring constant different from one another, and images were formed under environmental conditions of low temperature and low humidity (15° C., 10% RH) to evaluate the images thus formed.

The developing roller A used there was manufactured by the following method:

By the use of a mixer, a polyol composition was prepared by mixing 100 parts (parts by weight, the same applies hereinafter unless otherwise noted) of polyether polyol having a molecular weight of 5000 and an OH value of 33 mgKOH/g which had been prepared by adding propylene oxide and ethylene oxide to glycerol; 1.0 part of 1,4-butanediol; 0.5 part of nickel acetylacetonato; 0.01 part of dibutyltin dilaurate and 0.005 part of sodium perchlorate. The polyol composition thus prepared was defoamed by stirring under reduced pressure, then incorporated with 17.5 parts of urethane modified MDI (diphenylmethane diisocyanate), and stirred for 2 minutes.

Subsequently, the resultant mixture was cast into a mold in which a metallic shaft had been heated in advance to 110° C., was cured at 110° C. for 2 hours to form an electroconductive elastic layer on the outer periphery of the metallic shaft and thus to obtain a roller. The surface of the roller thus obtained was polished and adjusted to an average roughness Rz of 4.0 μm according to JIS 10 points.

Subsequently, a resin for forming a resin coated layer was prepared by mixing an oil-free alkyd resin (manufactured by Dainippon Ink and Chemicals, Inc. under the trade name "M 6402") and a melamine resin (solid content rate of 60% by weight, manufactured by Dainippon Ink and Chemicals, Inc. under the trade name "Superbekkamin L-145-60") so as to attain a solid content ratio by weight of the oil-free alkyd resin to the melamine resin of 80/20 in methyl ethyl ketone as the solvent, wherein the solid concentration was adjusted to 20% by weight.

Subsequently, 100 parts by weight expressed in terms of solid content of the resultant mixture was mixed with 20 parts (20 phr) by weight of carbon (average particle diameter of 18 nm, manufactured by Degussa Corp. under the trade name"PrintexL6") , and the resultant mixture was dispersed by the use of a paint shaker to prepare a coating solution.

The above-prepared roller was immersed into the coating solution, drawn up, and heated at 130° C. for 3 hours to cure the same and thus produce a developing roller A equipped with the resin coated layer. The resultant developing roller A had an outside diameter of 16.0 mm and a compression spring constant of 45N/mm, which was measured by the method as shown in FIG. 4 using the developing roller 6 instead of the toner supply roller 5.

In addition, toner supply rollers R, S, T, U, V, W and X which were used here were produced by using polyol prepolymers as the principal starting materials that had been prepared in the following manner.

A mixture was prepared by mixing 20 g of the mixture of 2,4-tolylene diisocyanate and 2,6-tolylene diisocyanate at a ratio by weight of 8:2 with the blend in a total weight of 90 g composed of 20 parts of polymer polyol having about 28% by weight of solid content composed, as a base polyol, of polyether polyol which had a weight average molecular weight of 5000 and which had been prepared by the addition to glycerol, of 15% by weight of ethylene oxide and 85% by weight of propylene oxide; 40 parts of hydrophilic polyether polyol which had a weight average molecular weight of 3400 and which had been prepared by the addition to glycerol, of 75% by weight of ethylene oxide and 25% by weight of propylene oxide; and 40 parts of polyether polyol which had a weight average molecular weight of 4800 and which had been prepared by the addition to glycerol, of 15% by weight of ethylene oxide and 85% by weight of propylene oxide. The resultant mixture was sufficiently stirred, heated to 60° C., and stirred every 12 hours repeatedly. Thus after 48 hours there was obtained a prepolymer of polyether polyol.

Subsequently, 110 g of the resultant prepolymer was mixed with 20 g of water, 0.1 g of tetraethylenediamine as an amine catalyst, 2.5 g of silicone based antifoam in which a hydroxy group was introduced at a terminal and 2.5 g of acetylene black.

Then the resultant mixture was poured into a cylindrical mold the inside of which was coated with teflon and an end of which was closable with a detachable lid, in an amount of 1.1 or 1.5 times a prescribed amount (a value which corresponds to the internal volume of a mold, and which is set to a standard prescribed amount of 1.0), and the lid was closed. Then the mold containing the mixture was allowed to stand in a hot air oven regulated to 70° C. for 8 to 10 hours to obtain foamed and cured polyurethane foam products.

Subsequently, the cured polyurethane foam was removed from the mold, passed through a roll, and subjected to glassing treatment.

Then, a hole with an inside diameter of 5 mm was bored at the center of the circular end of the cylindrical column, and into the hole was pressed a shaft which was made of galvanized sulfur free cutting steel, coated thereon with an adhesive and had an outside diameter of 6.0 mm and a length o 240 mm. The shafted polyurethane foam was subjected to heating adhesion treatment for 15 minutes in an oven at 60° C., and thereafter was polished with a grindstone, so that the outside diameter of the cylindrical columns was made to be 11.4 mm, 12.0 mm, 13.0 mm, 15.0 mm, 16.0 mm, 13.0 mm and 15.0 mm, respectively, whereby seven kinds of toner supply rollers R, S, T, U, V, W and X were produced. The number of cells per a length of 25 mm in the toner supply rollers R, S, T, U and V was in the range of 120 to 160, and the number thereof in the toner supply rollers W and X was in the range of 100 to 150. The compression spring constant of the toner supply rollers R, S, T, U and V was 1.5N/mm, and that of the toner supply rollers W and X was 4.5N/mm. The amount of the mixture poured into the mold for the purpose of preparing the toner supply rollers R, S, T, U, V, W and X and the outside diameter of the rollers are given in Table 4.

TABLE 4

| | Factor of poured amount (x prescribed amount) | Outside diameter of roller (mm) |
|---|---|---|
| Roller R | 1.1 | 11.4 |
| Roller S | 1.1 | 12.0 |
| Roller T | 1.1 | 13.0 |
| Roller U | 1.1 | 15.0 |
| Roller V | 1.1 | 16.0 |
| Roller W | 1.5 | 13.0 |
| Roller X | 1.5 | 15.0 |

As illustrated in FIG. 3, the toner supply rollers R through X are each constituted into a foamed elastic roller in which a roller 12 of a foamed elastic body is arranged around a metallic rotational shaft 11. In regard to the examples and comparative examples, image formation tests were carried out, by arranging any of the aforesaid toner supply rollers as a toner supply roller 5 as illustrated in FIG. 1. Since the distance between the shaft of the developing roller 6 and the shaft of the toner supply roller 5 was fixed to 13.5 mm, and the outside diameter of the developing roller 6 was 16.0 mm, the amount of the developing roller 6 cut into the toner supply rollers were 0.2 mm for the roller R with the outside diameter of 11.4 mm; 0.5 mm for the roller S with the outside diameter of 12.0 mm; 1.0 mm for the roller T with the outside diameter of 13.0 mm; 2.0 mm for the roller U with the outside diameter of 15.0 mm; 2.5 mm for the roller V with the outside diameter of 16.0 mm; 1.0 mm for the roller W with the outside diameter of 13.0 mm; and 2.0 mm for the roller X with the outside diameter of 15.0 mm.

In regard to the present examples and comparative examples, a measurement was made of the compression spring constant for the roller of foamed elastic body by the measuring method as illustrated in FIG. 4.

The toner supply roller to be used in the present examples and comparative examples, after being tested for compression spring constant as illustrated in FIG. 4, was subjected to image formation tests by arranging the same as a toner supply roller 5 of a printer as illustrated in FIG. 1, wherein the developing roller A was placed as the developing roller 6. Further, the image formation tests in the present examples and comparative examples were carried out under the environmental conditions of low temperature and low humidity (15° C., 10% RH) that were prone to manifest defective images. The results are given in Table 5.

TABLE 5

| | Toner supply roller | Cutting amount of developing roller (mm) | Compression spring constant (N/mm) | Pressing force, N | Image evaluation |
|---|---|---|---|---|---|
| Example 7 | R | 0.5 | 1.5 | 0.75 | ○ |
| Example 8 | S | 1.0 | 1.5 | 1.5 | ○ |
| Example 9 | T | 2.0 | 1.5 | 3.0 | ○ |
| Example 10 | U | 1.0 | 4.5 | 4.5 | ○ |
| Comparative Example 11 | V | 2.5 | 1.5 | 3,75 | x |
| Comparative Example 12 | W | 0.2 | 1.5 | 0.3 | x |
| Comparative Example 13 | X | 2.0 | 4.5 | 9.0 | x |

{Remarks} Regarding image evaluation, deep gray sound images were formed, wherein uniform and good image quality was marked with ○, and non-uniform image quality with unevenness in depth was marked with x.

EXAMPLES 11 to 13 and Comparative Examples 14 to 16

The printer as illustrated in FIG. 1 was incorporated with any of two kinds of developing roller (a) and (b), and any of three kinds of toner supply rollers x, y, and z which had each a electric resistance value different from one another, and images were formed under environmental conditions of low temperature with low humidity(15° C., 10% RH) and high temperature with high humidity(33° C., 85% RH) to evaluate the images thus formed.

The developing roller (a) used there was manufactured by the following method:

By the use of a mixer, a polyol composition was prepared by mixing 100 parts (parts by weight, the same applies hereinafter unless otherwise noted) of polyether polyol having a molecular weight of 5000 and an OH value of 33 mgKOH/g which had been prepared by adding propylene oxide and ethylene oxide to glycerol; 1.0 part of 1,4-butanediol; 0.5 part of nickel acetylacetonato; 0.01 part of dibutyltin dilaurate and 0.005 part of sodium perchlorate. The polyol composition thus prepared was defoamed by stirring under reduced pressure, then incorporated with 17.5 parts of urethane modified MDI (diphenylmethane diisocyanate), and stirred for 2 minutes.

Subsequently, the resultant mixture was cast into a mold in which a metallic shaft had been heated in advance to 110° C., was cured at 110° C. for 2 hours to form an electroconductive elastic layer on the outer periphery of the metallic shaft and thus to obtain a roller. The surface of the roller thus obtained was polished and adjusted to an average roughness Rz of 4.0 $\mu$m according to JIS 10 points.

Subsequently, a resin for forming a resin coated layer was prepared by mixing an oil-free alkyd resin (manufactured by Dainippon Ink and Chemicals, Inc. under the trade name "M 6402") and a melamine resin (solid content rate of 60% by weight, manufactured by Dainippon Ink and Chemicals, Inc. under the trade name "Superbekkamin L-145-60") so as to attain a solid content ratio by weight of the oil-free alkyd resin to the melamine resin of 80/20 in methyl ethyl ketone as the solvent, wherein the solid concentration was adjusted to 20% by weight.

Subsequently, 100 parts by weight expressed in terms of solid content of the resultant mixture was mixed with 20 parts (20 phr) by weight of carbon (average particle diameter of 18 nm, manufactured by Degussa Corp. under the trade name "PrintexL6"), and the resultant mixture was dispersed by the use of a paint shaker to prepare a coating solution.

The above-prepared roller was immersed into the coating solution, drawn up, and heated at 130° C. for 3 hours to cure the same and thus produce a developing roller (a) equipped with the resin coated layer.

The developing roller (b) was produced in the same manner as in the developing roller (a) except that the mixed amount of carbon was set to 10 parts (10 phr) by weight.

In addition, the toner supply roller (x) which was used here was produced by using polyol prepolymer as the principal starting material that had been prepared in the following manner.

Polyether polyol in an amount of 90 g which had a weight average molecular weight of 5000 and which had been prepared by the addition polymerization of ethylene oxide and propylene oxide with glycerol as the starting material was mixed with 20 g of the mixture of 2,4-tolylene diisocyanate and 2,6-tolylene diisocyanate at a ratio by weight of 8:2. The resultant mixture was sufficiently stirred, heated to 60° C., and stirred every 12 hours repeatedly. Thus after 48 hours there was obtained a prepolymer of polyether polyol, in which the content of the isocyanate was; 6.7% by weight.

Subsequently, 110 g of the resultant prepolymer was mixed with 20 g of water, 0.1 g of tetraethylenediamine as an amine catalyst, 2.5 g of silicone based antifoam in which a hydroxy group was introduced at a terminal and 2.5 g of acetylene black.

Then the resultant mixture was poured into a cylindrical mold the inside of which was coated with teflon and an end of which was closable with a detachable lid, and the lid was closed. Then the mold containing the mixture was allowed to stand in a hot air oven regulated to 70° C. for 8 hours to obtain foamed and cured polyurethane foam products.

Subsequently, the cured polyurethane foam was removed from the mold by detaching the lid at the end, passed through a roll, and subjected to glassing treatment.

Then, a hole with an inside diameter of 5 mm was bored at the center of the circular end of the cylindrical column, and into the hole was pressed a shaft which was made of galvanized sulfur free cutting steel, coated thereon with an adhesive and had an outside diameter of 6.0 mm and a length o 240 mm. The shafted polyurethane foam was subjected to heating adhesion treatment for 15 minutes in an oven at 60° C., and thereafter was polished with a grindstone, so that the outside diameter of the cylindrical columns was made to be 13.0 mm, whereby the toner supply roller (x) was produced. The number of cells per a length of 25 mm in the toner supply roller (x) was in the range of 150 to 160, and Asker F hardness of the foam was in the range of 70 to 80 degrees.

The toner supply rollers (y) and (z) were produced in the same manner as in the above-mentioned toner supply roller (x) except that the mixed amount of acetylene black was set to 2.0 g and 1.0 g, respectively instead of 2.5 g. The number of cells per a length of 25 mm in the toner supply roller (y) was in the range of 150 to 170 and that in the toner supply roller (z) was in the range of 140 to 160. The Asker F hardness of the foam in the toner supply roller (y) was in the range of 80 to 90 degrees and that in the toner supply roller (z) was in the range of 70 to 80 degrees.

Figure 5:
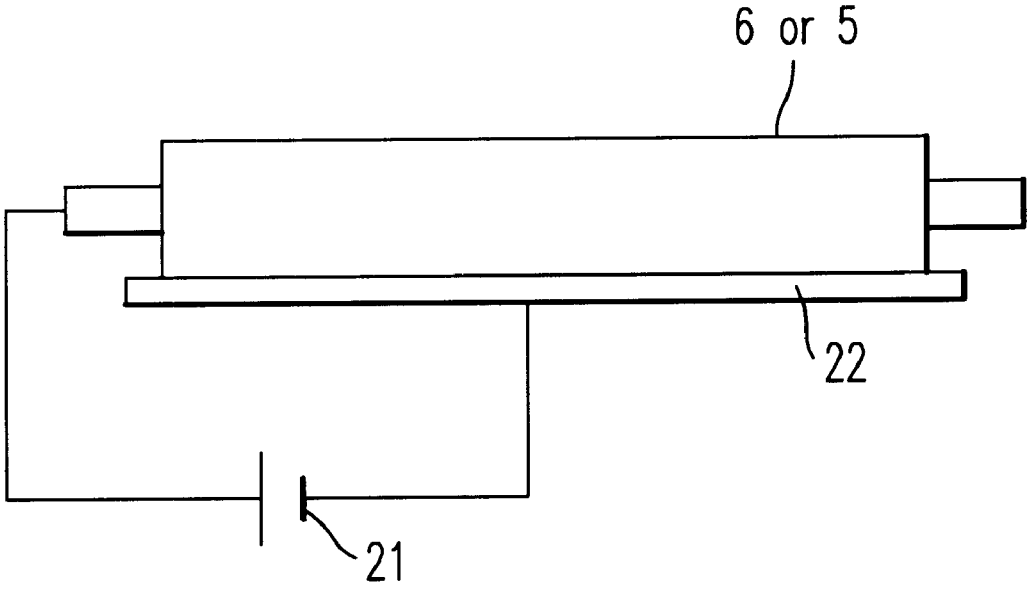
FIG. 5 is a schematic illustration showing a method for measuring the electric resistance of the electroconductive roller as indicated in working examples.
Figure 6:
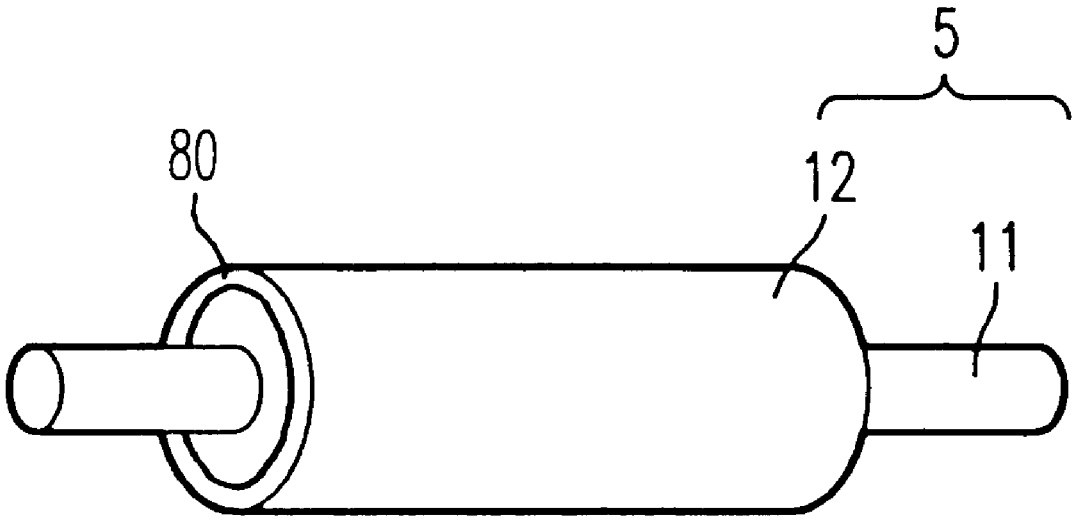
FIG. 6 is a schematic perspective illustration of a developing roller according to one embodiment of the present invention.

Examples 11 to 13 constitute the combination in which the electric resistance of any of the toner supply rollers was always lower than that of any of the developing roller, whereas Comparative Examples 14 to 16 constitute the reverse combination regarding electric resistance. The results of image evaluation along with the electric resistance values of the toner supply rollers and the developing rollers are given in Table 6, in which the electric resistance values are expressed in terms of common logarithmic values (Ω). The measurement of electric resistance was carried out by the method as illustrated in FIG. 5 wherein the symbols 21 and 22 denote impressed voltage and an aluminum sheet, respectively.

TABLE 6

| | Examples | | | Comparative Examples | | |
|---|---|---|---|---|---|---|
| | 11 | 12 | 13 | 14 | 15 | 16 |
| Working environment | | | | | | |
| Temperature | 15° C. | 15° C. | 33° C. | 15° C. | 15° C. | 33° C. |
| Humidity | 10% | 10% | 85% | 10% | 10% | 85% |
| Impressed voltage (developing roller) | 300V | 300V | 300V | 300V | 300V | 300V |
| Impressed voltage (toner supply roller) | 200V | 200V | 200V | 200V | 200V | 200V |
| Kind of developing roller | a | b | b | a | b | b |
| Kind of toner supply roller | x | y | y | z | z | z |
| Electric resistance of developing roller (Rd) | 6.5~7.0 | 9.0~9.5 | 6.5~7.0 | 6.5~7.0 | 9.0~9.5 | 6.5~7.0 |
| Electric resistance of toner supply roller (Rt) | 4.5~5.0 | 7.5~8.0 | 5.5~6.0 | 9.5~10.0 | 9.5~10.0 | 7.0~7.5 |
| Relation between electric resistance of developing roller (Rd) and electric resistance of toner supply roller (Rt) | Rd > Rt | Rd > Rt | Rd > Rt | Rd < Rt | Rd < Rt | Rd < Rt |
| Image evaluation | ○ | ○ | ○ | x | x | x |

{Remarks} Regarding image evaluation, deep gray sound images were formed, wherein uniform and good image quality was marked with ○, and non-uniform image quality with unevenness in depth was marked with x.

What is claimed is:

1. A toner supply roller for a developing apparatus, comprising a foamed elastic body having a compression spring constant in a range of 0.25 to 5.0 N/mm.

2. The toner supply roller according to claim 1, wherein the compression spring constant has a variation range in the circumferential direction within a prescribed value ±20%.

3. The toner supply roller according to claim 1, wherein the compression spring constant has a variation range in the longitudinal direction between 20 mm from one end and 20 mm from the other end within a prescribed value ±20%.

4. The toner supply roller according to claim 1, further comprising a shaft wherein the foamed elastic body comprises a foamed elastic layer formed on the shaft, and has a plurality of cells per a length of 25 mm in a range of 50 to 1200.

5. The toner supply roller according to claim 4, wherein the shaft comprises an electroconductive shaft, and the foamed elastic layer is an electroconductive foamed elastic layer.

6. The toner supply roller according to claim 1, wherein the foamed elastic body has an average foamed cell diameter in the range of 20 to 200 μm and the number of cells per a length of 25 mm in the range of 50 to 1200, and which has a compression spring constant in the range of 0.25 to 5.0 N/mm.

7. The toner supply roller according to claim 6, wherein the foamed elastic body has an average foamed cell diameter in the range of 50 to 180 μm and the number of cells per a length of 25 mm in the range of 100 to 450, and which has a compression spring constant in the range of 0.4 to 4.0 N/mm.

8. The toner supply roller according to claim 6, further comprising an electroconductive shaft, wherein the formed elastic body comprises an electroconductive foamed elastic layer formed on the electroconductive shaft.

9. The toner supply roller according to claim 8, wherein the electroconductive shaft is a metallic shaft, and the electroconductive foamed elastic layer is imparted with electroconductivity by electroconductive carbon.

10. A developing apparatus on which the toner supply roller as set forth in claim 1 is mounted.

11. An image formation apparatus which is equipped with the developing apparatus as set forth in claim 10.

12. The toner supply roller according to claim 1, wherein the foamed elastic body comprises a material selected from the group consisting of ester-based polyurethane foam, ether-based polyurethane foam, nitrile rubber foam, ethylene-propylene rubber foam, ethylene-propylene-diene rubber foam, styrene-butadiene rubber foam, butadiene rubber foam, isoprene rubber foam, natural rubber foam, silicone rubber foam, acrylic rubber foam, chloro-prene rubber foam, butyl rubber foam, epichlorohydrin rubber foam, and a combination thereof.

13. A developing apparatus for forming a toner image by supplying a toner to an electrostatic latent image on a photosensitive body, the developing apparatus comprising:

a toner cartridge housing a toner as a developer;

a toner supply roller including a foamed elastic body having a compression spring constant ranging from 0.25 to 5.0 N/mm; and a developing roller configured to make contact with the toner supply roller and deform due to the deformation of the toner supply roller;

wherein the toner supply roller has a cutting amount caused by the developing roller in a range of 0.5 to 2 mm, and a pressing force against the developing roller at most 6.0N.

14. The developing apparatus according to claim 13, wherein the difference between the compression spring constant of the toner supply roller and the compression spring constant of the developing roller is at least 30N/mm.

15. An image formation apparatus which is equipped with the developing apparatus as set forth in claim 13.

16. A developing apparatus for forming a toner image by supplying a toner to an electrostatic latent image on a photosensitive body, comprising:

a toner cartridge housing a toner as a developer;

an electroconductive toner supply roller positioned to supply the toner; and an electroconductive developing roller positioned to develop an electrostatic latent image on the photosensitive body with the toner and having an electric resistance in a range between $1\times10^{6.5}$ and $1\times10^{11}$ (Ω);

wherein:

the toner supply roller has an electric resistance which is lower than an electric resistance of the developing roller at an impressed voltage in a range of 100V to 500V; and a difference between the electric resistance of the toner supply roller and the electric resistance of the developing roller is at least 0.5 expressed in terms of common logarithmic value thereof (Ω).

17. The developing apparatus according to claim 16, wherein the toner is a unary nonmagnetic toner.

18. The developing apparatus according to claim 16, wherein the developing roller is a contact electroconductive roller.

19. The developing apparatus according to claim 16, wherein the developing roller comprises an electroconductive shaft, a foamed elastic body formed around the electroconductive shaft as an electroconductive foamed elastic layer, and one of a layer of a resin different from said electroconductive foamed elastic layer and a layer of a resin in which the resin is blended with one of electroconductive fine particles and semi-electroconductive fine particles.

20. The developing apparatus according to claim 16, wherein:

the toner supply roller comprises an electroconductive shaft and the foamed elastic body formed around the electroconductive shaft as an electroconductive foamed elastic layer; and the electroconductive foamed elastic layer has the number of cells per a length of 25 mm being in the range of 50 to 1200, and an Asker F hardness being in the range of 30 to 100 degrees.

21. An image formation apparatus which is equipped with the developing apparatus as set forth in claim 16.

* * * * *